United States Patent [19]

Tamura et al.

[11] 3,980,167

[45] Sept. 14, 1976

[54] ENTRY CONTROL DEVICE

[75] Inventors: Takanori Tamura, Nagaokakyo; Koichi Imoto, Omihachiman, both of Japan

[73] Assignee: Omron Tateisi Electronics Co., Japan

[22] Filed: Dec. 30, 1974

[21] Appl. No.: 537,390

[52] U.S. Cl. ..... 194/4 R

[51] Int. Cl.[2] ..... G07F 1/06

[58] Field of Search ..... 194/4 R, 4 G, 54, 67, 194/102, 99, DIG. 20; 49/35

[56] References Cited

UNITED STATES PATENTS

| | | | |
|---|---|---|---|
| 461,461 | 10/1891 | Whiteside | 194/102 |
| 617,421 | 1/1899 | Mason | 194/102 |
| 3,443,675 | 5/1969 | Yamamoto et al. | 194/4 R |
| 3,766,687 | 10/1973 | Henson | 49/35 |
| 3,815,719 | 6/1974 | Streeter et al. | 194/4 G |

*Primary Examiner*—Stanley H. Tollberg
*Attorney, Agent, or Firm*—Craig & Antonelli

[57] ABSTRACT

An entry control device for coded credit cards or the like to be incorporated in a dispensing machine which includes a main body having a card gate gradually narrowed inward to define a passage for passing selected sized cards, a shutter plate pivotally provided behind the passage, a pair of rollers rotatably mounted on corresponding shafts pivotally connected to the main body and adapted to be urged to engage corresponding notches formed in the main body, and a card reader electrically associated with a second shutter plate, by which arrangement, only a proper selected sized card is permitted to enter the internal dispensing mechanism with any odd sized cards or debris advantageously prevented from being forced or jammed into the machine.

8 Claims, 4 Drawing Figures

ENTRY CONTROL DEVICE

The present invention relates to an entry control device, and more particularly to an entry control device for coded cards or the like to be incorporated in an identification system, such as a dispensing machine, a depository machine, a security gate, etc.

Conventionally, in dispensing machines of various kinds for dispensing, for example, currency, gasoline, food etc., in which properly coded credit cards or the like are employed for operation thereof, there is provided a card entry gate, mostly in the front panel of the machine, to receive a credit card to be inserted thereinto by a user for operating the dispensing system which is located within the machine through code reading and transport mechanisms disposed behind the entry gate.

However, it has been a serious problem in such conventional dispensing machines of the above described type that the entire dispensing system, although reliably built, is sometimes rendered inoperative due to insertion of odd sized cards or debris such as pieces of metal or paper by pranksters into the entry gate with the code reading mechanism considerably damaged.

In some of the conventional entry control devices, a sensing means for electrically detecting the coded data recorded in the card is provided behind the card entry gate for the entry control device, with a shutter member or the like further disposed behind the sensing means. The sensing means is adapted to function to open the shutter member, only when the card is of correct characteristics, which sensing means positioned prior to the shutter member, however, is not protected against miscellaneous debris which may be inserted through the entry gate, and besides, since a certain period of time is required between the actuation of the sensing means and the opening of the shutter member, a portion with distance equivalent to such a period of time is kept between the sensing means and the shutter member. Accordingly, pieces of metal or paper, if forced into such a portion through the card gate, not only result in jamming, but give rise to serious troubles in the sensing means associated with internal electrical circuit and dispensing mechanism.

In order to overcome such disadvantages, there is conventionally proposed an apparatus for document entry control into a dispensing system, for example, by the U.S. Pat. No. 3,766,687, in which the apparatus includes a housing or main body having a passage therein to receive and orient a presented document, such as a coded card, for transport into the system, an actuating lever internal within the system, and pivotally mounted to the housing to rotate about a position intermediate with the passage, triggers pivotally mounted to the actuating lever and extending into the passage of the housing, locking bars also pivotally mounted to the actuating lever to be rotated from a first position to a second position by actuating the triggers to engage the locking bars, and a gate also pivotally mounted to the actuating lever and locking in a first position for barring entry of a document into the system by engagement with the locking bars when the locking bars are in the first position. The gate is adapted to rotate to the second position by a document in the passage when the locking bars are rotated by the triggers into the second position thereof.

In the above prior art entry control apparatus wherein locking bars are employed for engaging with and supporting the entry gate in an opened state or for disengaging from and releasing the same into a closed position through the triggers provided in the opposite sides of the entry gate, with the locking bars pivotally mounted to the actuating lever which is in turn pivotally mounted to the housing or the main body of the apparatus and with the entry gate pivotally supported by the actuating lever, it is inevitable that the construction of the apparatus is complicated with consequent high cost, and especially when the card is inserted through the card throat, part of the leading edge of the card may be damaged or worn out at the opposite corners thereof to a certain extent after repeated use by the contact with the triggers. Additionally, from the view point of construction, the presence of the intermediate members, i.e., the locking bars which require very accurate functioning may result in unstable operation of the entry control apparatus.

Accordingly, an essential object of the present invention is to provide an entry control device for coded credit cards or the like to be incorporated in a dispensing machine in which only selected sized cards are permitted to enter the dispensing mechanism, and which is simple in construction and consequently low in manufacturing cost with substantial elimination of the disadvantages inherent in the conventional entry control devices.

Another important object of the present invention is to provide an entry control device of the above described type which is accurate in functioning and stable in operation with debris or the like positively prevented from being forced or jammed thereinto.

A further object of the present invention is to provide an entry control device of the above described type which is easy to operate for a user, requiring little force in card insertion with minimum wearing or damage to the cards even after repeated use.

According to a preferred embodiment of the present invention, the entry control device comprises a main body having a card gate in the front portion thereof, which card gate is communicated with a passage for receiving and orientating an inserted selected sized card for transportation into the internal dispensing mechanism, a shutter plate pivotally disposed behind the passage with a short distance kept between an inner edge of the passage and the shutter plate for permitting the shutter plate to rotate about the pivotal connection and with the shutter plate normally urged to an upright position by a spring, a pair of rollers rotatably mounted on corresponding levers which are pivotally connected at the upper ends thereof to a member fixed on the main body and which are urged inward by springs toward the passage so that the rollers engage corresponding notches formed in the main body adjacent opposite corners of the passage so as to partly block the path of the card through the passage at said opposite corners of the passage, stoppers provided at the lower ends of the roller levers and adapted to engage the lower surface of the shutter plate so as to hold the shutter plate in said upright position, while the rollers engage the notches, and also adapted to disengage from the shutter plate, when the rollers are pushed apart by the card to leave the notches, so as to permit the shutter plate to rotate or incline, and a card reader disposed behind the shutter plate for detecting the characteristics of the card and for actuating a solenoid to open a second shutter so as to permit the card to pass therethrough into the internal mechanism only when the card is of proper selected kind. The card to be inserted, if it is of properly selected size, passes through the passage, and subsequently presses the rollers apart for the latter to disengage from the notches with the stoppers of the levers also disengaged from the shutter plate. The shutter plate can then be inclined or rotated by the force applied to the card for insertion, permitting the card to pass therethrough into the card reading portion. Accordingly, the card to be inserted is subjected to double examinations, i.e., first at the passage for correct size and subsequently at the card reader for characteristics in material thereof, and any odd sized cards or debris such as pieces of metal or paper are advantageously prevented from entering the internal dispensing mechanism. Furthermore, should jamming occur in the portion between the passage and the shutter plate, any debris clogged in this portion is adapted to fall down into the space provided between the passage and the shutter plate when the card pushes and rotates the shutter plate toward the passage as it returns back into the card gate after being processed in the internal mechanism. The problem of wearing-out or damage to the card due to repeated use is advantageously solved by the adoption of the rotatable rollers.

Furthermore, the construction with the shutter plate disposed behind the card gate, and with the card reader further disposed behind the shutter plate is effective for protecting the card reader against damage due to direct contact with the debris forced into the card gate.

These and other objects and features of the present invention will become apparent from the following description taken in conjunction with the preferred embodiment thereof with reference to the accompanying drawings, in which.

Before description of the present invention proceeds, it is to be noted that like parts are designated by like numerals throughout several views of the accompanying drawings.

Figure 1:
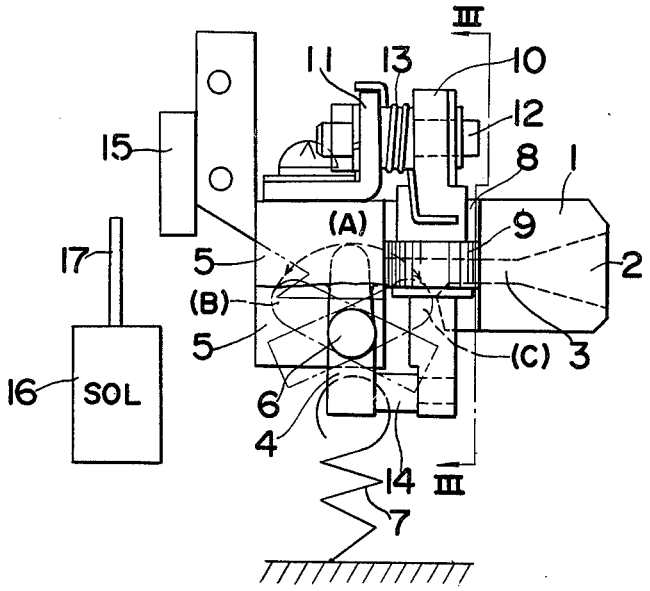
FIG. 1 is a schematic diagram showing a side elevational view of an entry control device according to the present invention.
Figure 2:
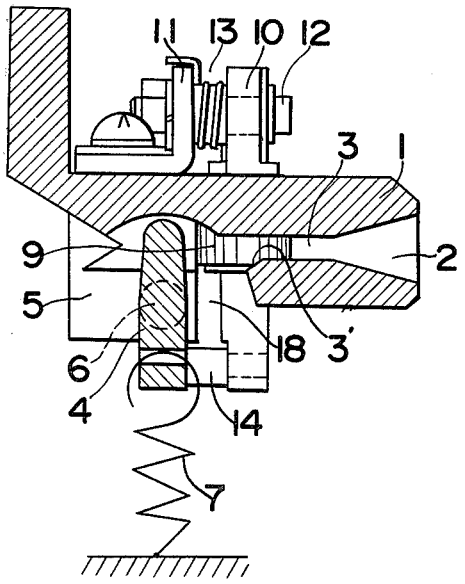
FIG. 2 is a similar view to FIG. 1, but particularly shows a sectional view of the main body and the arrangement of shutter plate with a card reader portion removed.
Figure 3:
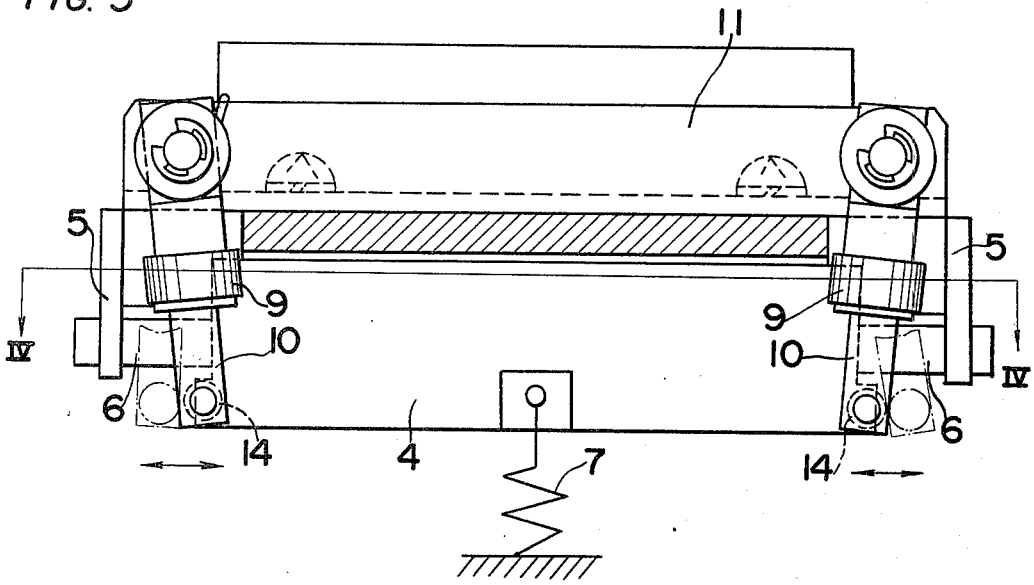
FIG. 3 is a cross sectional view taken along the line III—III in FIG. 1.
Figure 4:
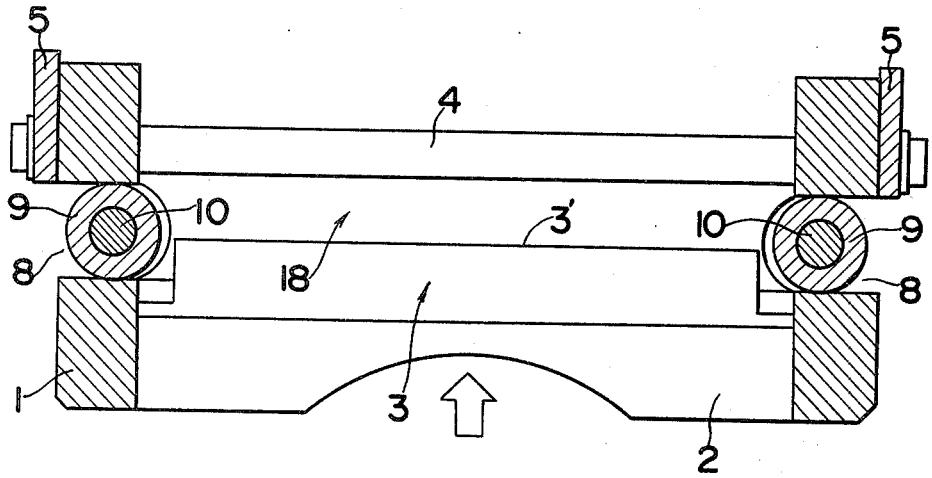
FIG. 4 is a cross sectional view taken along the line IV—IV in FIG. 3.

Referring to FIGS. 1 to 4, there is shown an entry control device for coded credit cards or the like to be incorporated in a dispensing machine. A housing or main body 1 extending the width of an elongated opening (not shown) formed in the front panel (not shown) of a dispensing machine is formed with a card gate 2 at the front portion thereof at the right in FIGS. 1 and 2 for receiving a credit card, which card gate 2 is gradually narrowed in height inwardly to define a passage 3 communicating with the card gate 2 and somewhat shorter in width than the card gate 2 for accepting and orientating an inserted card for transport into the dispensing machine if the card is of selected size. In a space formed in the main body 1 behind the passage 3 where the lower portion 3′ of the passage 3 ends at the left in FIGS. 1 and 2, a shutter plate 4 pivotally mounted to the main body 1 is disposed in a position which is spaced away from the rear edge of the lower portion 3′ of the passage 3, but which will block the path of the card inserted through the passage 3. The shutter plate 4 extending the width of the passage 3 is pivotally connected, at opposite sides thereof, by pins 6 to corresponding extensions 5 integrally formed with or fixedly attached to the main body 1 with the lower central portion of the shutter plate 4 connected to one end of a spring 7 whose other end is connected to a frame or a suitable fixing member (not shown) of the dispensing machine so as to hold the shutter plate 4 in an upright neutral position (A) as shown in FIG. 2.

It should be noted here that the shutter plate 4 is adapted to rotate counterclockwise about the pins 6 up to a position (B) shown by a chain line in FIG. 1 when pressed by a proper sized card inserted through the card gate 2, and that the same is also rotatable clockwise up to a position (C) shown by a chain line, when pressed by the card being sent back from the internal dispensing mechanism, so as to permit the passing of such cards, and that a sufficient space 18 is provided between the lower edge 3′ of the passage 3 and the shutter plate 4 for enabling the shutter plate 4 to rotate freely up to the position (C), although the function of the shutter plate 4 is described more in detail hereinbelow. In the opposite sides of the main body 1 in positions between the card gate 2 and the shutter plate 4, notches 8 of semi-circular configuration are formed with the distance between the notches 8 adapted to be shorter than the width of the card which is also limited by the width of the passage 3. In each of the notches 8, a roller 9 which is rotatably mounted at a middle portion of a lever 10 is releasably received so as to block part of the opposite corners of the passage 3. The lever 10 is in turn pivotally connected, at the upper portion thereof, to a pin 12 which is secured to a supporting member 11 of an L-shaped cross section fixed on the rear portion of the main body 1 in a direction parallel to the shutter plate 4, and which extends in a direction normal to the passage 3 with each of the levers 10 urged inwardly toward the notches 8 and consequently the passage 3 by a spring 13 mounted on the pin 12 between the upper portion of the lever 10 and the supporting member 11. On the lower end portion of each of the levers 10, a stopper 14 extending toward the shutter plate 4 is fixedly mounted. Each of the stoppers 14 is adapted to contact, at the tip thereof, the lower surface of the shutter plate 4 to prevent the shutter plate 4 from inclining inward, i.e., from rotating counterclockwise about the pins 6 when the rollers 9 of the levers 10 are in the notches 8, partly entering the path of the card through the passage 3, while, when the rollers 9 are pressed well apart outwardly by the insertion of a selected sized card, the stoppers 14 are disengaged from the shutter plate 4, permitting the shutter plate 4 to rotate inward, i.e., counterclockwise in FIGS. 1 and 2.

A proximity switch 15 or a card reader is mounted in a position above the path of the card, on the rear portion of the main body 1 which extends upwardly at right angles from the surface of the body 1 for detecting the presence of a metal film or the like embedded in the credit card. If the card is of proper characteristics in the material thereof, the proximity switch 15 functions to actuate a solenoid 16 so as to open a second shutter 17 which permits the card to enter the internal dispensing mechanism for necessary dispensing operation.

It should be noted here that, in cases where a magnetic card is employed, a magnetic head may be employed instead of the proximity switch 15 for detecting the presence of the magnetism in the card.

The card to be inserted into the entry control device of the invention is first limited by the width of the passage 3 and any card having width larger than that of the passage 3 can not be inserted into the machine.

Even when a card with width thereof shorter than that of the passage 3 is inserted, if the width of the card is less than that of a selected sized card, such a card does not properly push both of the rollers 9 apart simultaneously, either forcing only one of the rollers 9 to move outwardly or pressing the rollers 9 insufficiently apart, in which state the shutter plate 4 is not inclined since simultaneous disengagement of both of the stoppers 14 from the shutter plate 4 can not be achieved.

By this arrangement, when a selected sized card with sufficient width to force both of the rollers 9 outward simultaneously is inserted into the passage 3 through the card gate 2, the rollers 9 are perfectly pressed apart outwardly away from the notches 8 with the lower end portions of the levers 10 moving outwardly against the urging force of the springs 13 and the stoppers 14 simultaneously disengaged from the shutter plate 4, and with consequent inward inclination of the shutter plate 4 up to a position (B) in FIG. 1 by the force applied to the shutter plate 4 due to card insertion.

As the card is further inserted, the data recorded on the card are detected by the proximity switch 15 which prevents further insertion of the card if the card is of improper kind, and which actuates the solenoid 16 to open the second shutter 17 for introducing the card into the despensing mechanism if the card is of a properly selected size.

It is needless to say that the rollers 9 re-engage the notches 8 to block part of the opposite corner portions of the passage 3 by the urging force of the springs 13 after the card has passed through the portion between the rollers 9.

When the card is returned toward the card gate 2 after having been processed by the internal dispensing mechanism of the machine, the card passes through the second shutter 17 which still remains opened, and is forwarded back into the card gate 2 through the passage 3, forcing the shutter plate 4 to incline outward, i.e., to turn clockwise up to a position (C) in FIG. 1 by the force applied by the card being transported.

Should miscellaneous debris such as pieces of metal or paper be inserted into the card gate 2 and presses the shutter plate 4, the shutter plate 4 never rotates to permit entrance of such debris since the plate 4 is prevented from inclination by the stoppers 14 against such improper pushing.

Furthermore, in cases where debris should be jammed in the portion after the card gate 2 between the passage 3 and the shutter plate 4, such debris falls, upon insertion of a next card, into the space 18 between the lower portion 3' and the shutter plate 4, provided for enabling the shutter plate 4 to rotate clockwise up to the position (C) in returning the processed card back into the card gate 2.

It should be noted here that the rollers 9 serving as a card width detection member and provided in pairs, i.e., one at the right and the other at the left of the passage 3 described as employed in the above embodiment are not necessarily be in pairs, but that only one of such rollers provided at either side of the passage 3 may serve the purpose, in which case, simpler construction and consequent lower cost may be achieved although protection against entry of undesirable items may be slightly reduced.

It should also be noted that the rollers 9 rotatably mounted on the levers 10 described as employed in the above embodiment may be dispensed with or replaced by any other fixed members, but that, by the adoption of the rotatable rollers 9, friction between the rollers 9 and the card is remarkably reduced, requiring less force in card insertion, and consequently edges of a card are advantageously protected from damage or wearing out even when the same card is repeatedly used for a long period of time.

The entry control device of the present invention is not limited in its use to a dispensing machine for any one particular purpose, such as a cash dispenser or the like but is also applicable to any other identification systems, for example, a depository machine, a security gate etc. in which coded cards are employed.

As is clear from the foregoing description, since the construction of the device of the invention is such that the width of the card is first detected by the width of the passage and the distance between the rollers, and the shutter plate is adapted to open only when the selected sized card of proper width is inserted to press the rollers sufficiently apart, only a small distance is required between the card gate and the shutter plate for providing the passage and the rollers as the width detection means. Even when debris such as pieces of metal or paper be inserted between the passage and the shutter plate, such debris falls into the space provided between the passage and the shutter plate with jamming advantageously prevented.

Since such debris never goes beyond the shutter plate, the card reader or the proximity switch disposed behind the shutter plate is perfectly protected from any damage due to direct contact with the debris.

Furthermore, in the entry control device of the invention, since the passage or the rollers as width detection members are of mechanical construction without being directly connected to the internal electrical dispensing system of the machine, troubles concerning electrical system are advantageously prevented even if miscellaneous debris such as pieces of metal or paper etc., should be forced into the cord gate.

The provision of the second shutter to be actuated by the solenoid through the proximity switch is very effective for further protecting the internal dispensing mechanism of the dispensing machine.

Although the present invention has been fully described by way of example with reference to the attached drawings, it should be noted that various changes and modifications are apparent to those skilled in the art. Therefore, unless otherwise such changes and modifications depart from the scope of the present invention, they should be construed as included therein.

What is claimed is:

1. An entry control device for coded cards or the like to be incorporated in an identification system which comprises a main body having a passage therein for receiving and orientating a card into the identification system and notches formed in said main body adjacent to opposite corners of said passage so that part of each of said notches enters a path of the card through said passage, a pair of pins mounted on said main body in positions above said notches and extending in a direction parallel to said path of the card, a corresponding pair of width detection levers pivotally mounted on said pins, each of said width detection levers having a roller rotatably mounted on said lever at a position corresponding to each of said notches, spring means mounted on said pins for urging each of said levers inwardly toward said passage and consequently for holding said rollers in said notches, said rollers being adapted to be in a first position engaging said notches with part of each of said rollers blocking said path of the card through said passage at opposite corners of said passage, and said rollers also being adapted to be pressed apart, when a selected sized card is inserted therebetween, by side edges of said selected sized card, with said width detection levers being rotated outwardly away from said passage about said pins against the urging force by said spring means and with said rollers being moved to a second position, and a gate member which is pivotally connected to said main body by a shaft, said gate member having an upper end normally projecting into said path of the card through said passage, and said gate member having a lower portion connected to a spring member for urging said gate member into a normally upright position, said gate member being adapted to be prevented from rotation about said shaft in the direction of card insertion by said width detection levers contacting corresponding ends of the lower portion of said gate member when said rollers are in said first position and also being adapted to rotate about said shaft in a direction of card insertion wherein said width detection levers are disengaged from said corresponding ends of said lower portion of said gate member when said rollers have been moved to said second position for permitting the card to pass therethrough, said gate member also being adapted to rotate freely about said shaft in a direction of card returning when said card is returned from said identification system back into said passage.

2. An entry control device for coded cards or the like to be incorporated in an identification system which comprises, a first member having a passage therein for receiving and orientating a card into the identification system, a second member which is normally urged to a first position adjacent to said passage with part of said second member blocking a path for the card through said passage at said passage, and which is moved to a second position upon insertion of a selected sized card, a third member pivotally supported in said first member adjacent to said passage, said third member being adapted to project into said path of the card when said second member is in said first position with rotation of said third member prevented by said second member in said first position so as to prevent the card from passing therethrough, and also being adapted to rotate when said second member has been moved to said second position so as to permit the card to pass therethrough, and a fourth member disposed behind said third member in said path of said card for controlling passing of the card, said fourth member being electrically connected to a detecting member disposed between said third member and said fourth member for detecting characteristics in material of the card and for permitting said card to pass said fourth member if said characteristics of the card are proper and for preventing the card from passing said fourth member if said characteristics of the card are improper, wherein said second member comprises a pair of width detection levers pivotally mounted at an upper portion of said first member in positions above said passage, and wherein said width detection levers are further provided with corresponding rollers rotatably mounted at middle portions thereof.

3. An entry control device for coded cards or the like to be incorporated in an identification system which comprises, a first member having a passage therein for receiving and orientating a card into the identification system, a second member which is normally urged to a first position adjacent to said passage with part of said second member blocking a path for the card through said passage as said passage, and which is moved to a second position upon insertion of a selected sized card, a third member pivotally supported in said first member adjacent to said passage, said third member being adapted to project into said path of the card when said second member is in said first position with rotation of said third member prevented by said second member in said first position so as to prevent the card from passing therethrough, and also being adapted to rotate when said second member has been moved to said second position so as to permit the card to pass therethrough, and a fourth member disposed behind said third member in said path of said card for controlling passing of the card, said fourth member being electrically connected to a detecting member disposed between said third member and said fourth member for detecting characteristics in material of the card and for permitting said card to pass said fourth member if said characteristics of the card are proper and for preventing the card from passing said fourth member if said characteristics of the card are improper, wherein said second member comprises a width detection lever pivotally mounted at an upper portion of said first member in a position above said passage, and wherein said width detection lever is further provided with a roller rotatably mounted at a middle portion thereof.

4. An entry control device as claimed in claim 1, wherein a second gate member is further provided behind said gate member in said path of the card, said second gate member being electrically connected, through a solenoid, to a card reader disposed above said path of the card between said gate member and said second gate member, said card reader being adapted to detect characteristics in material of said card so as to actuate said solenoid to open said second gate member for permitting said card to pass said second gate member into said identification system if said characteristics of the card is proper and so as to actuate said solenoid to close said second gate member for preventing the card from passing therethrough if said characteristics of the card is improper.

5. An entry control device as claimed in claim 4, wherein said second gate member is adapted to remain open when said card having proper characteristics permitted to enter said identification system is returned back toward said passage after having been processed in said identification system.

6. An entry control device as claimed in claim 1, wherein said gate member is a plate-like, rectangular member having a longitudinally extending edge portion forming said upper end of said gate member, said plate-like member being disposed transversely to said path of the card.

7. An entry control device as claimed in claim 6, wherein said shaft is arranged at a central portion of said plate-like, rectangular member parallel to said longitudinally extending edge portion such that said plate-like member is freely rotatable about said shaft.

8. An entry control device as claimed in claim 1, wherein said gate member is spaced from said notches and said rollers in the direction of said passage of said card insertion such that a predetermined separation is provided for removing debris and unauthorized objects from said passage.

* * * * *